US006211813B1

(12) United States Patent
Dousset et al.

(10) Patent No.: US 6,211,813 B1
(45) Date of Patent: Apr. 3, 2001

(54) COMPACT MONOPULSE SOURCE FOR A FOCAL FEED REFLECTOR ANTENNA

(75) Inventors: Thierry Dousset, Saint Gratien; Xavier Delestre, Paris, both of (FR)

(73) Assignee: Thomson-CSF, Paris (FR)

( * ) Notice: Subject to any disclaimer, the term of this patent is extended or adjusted under 35 U.S.C. 154(b) by 0 days.

(21) Appl. No.: 09/081,229

(22) Filed: May 20, 1998

(30) Foreign Application Priority Data

May 23, 1997 (FR) ..... 97 06327

(51) Int. Cl.[7] ..... H01Q 25/02

(52) U.S. Cl. ..... 342/153; 342/427; 333/120; 333/125; 333/26; 343/781 CA; 343/837

(58) Field of Search ..... 333/117, 120, 333/125, 137, 26, 248; 342/153, 427; 343/781 CA, 837

(56) References Cited

U.S. PATENT DOCUMENTS

| | | | | |
|---|---|---|---|---|
| 3,510,875 | | 5/1970 | Beguin | 343/786 |
| 4,550,296 | | 10/1985 | Ehrlinger et al. | 333/26 |
| 4,721,959 | * | 1/1988 | Syrigos | 333/117 X |
| 4,904,966 | * | 2/1990 | Rubin | 333/120 |
| 5,202,648 | | 4/1993 | McCandless | 333/26 |
| 5,614,874 | * | 3/1997 | McCandless | 333/125 |
| 5,770,981 | * | 6/1998 | Koizumi et al. | 333/33 X |

FOREIGN PATENT DOCUMENTS

| | | |
|---|---|---|
| 0 148 136 A1 | 7/1985 | (EP) . |
| 0 634 667 A2 | 1/1995 | (EP) . |

OTHER PUBLICATIONS

Patent Abstracts of Japan, vol. 18, No. 240, (E–1545), May 9, 1994, JP 06 029720 A, Feb. 4, 1994.

* cited by examiner

*Primary Examiner*—Benny T. Lee
(74) *Attorney, Agent, or Firm*—Oblon, Spivak, McClelland, Maier & Neustadt, P.C.

(57) ABSTRACT

A monopulse source for a focal feed antenna including at least two waveguides machined in a metal flange supporting a microwave transmission and reception circuit of the antenna, and a dielectric substrate on the metal flange. Also included is a microwave short-circuit having an opening with a smaller dimension than a dimension of a respective waveguide. The microwave short-circuit is mounted on the dielectric substrate such that an axis of the microwave short-circuit coincides with an axis of the respective waveguide. Further, a transition positioned on the dielectric substrate and within the opening of the microwave short-circuit is configured to couple the respective waveguide.

16 Claims, 9 Drawing Sheets

COMPACT MONOPULSE SOURCE FOR A FOCAL FEED REFLECTOR ANTENNA

BACKGROUND OF THE INVENTION

The present invention relates to a primary source with at least two channels, called a monopulse source such as, for example, a Cassegrain or lens type reflector antenna connected to a microwave transmission and reception circuit. It can be applied especially to millimeter wave radars fitted into automobiles. More generally, it can be applied to millimeter wave radars requiring a high level of integration and low-cost manufacture.

A source known as a monopulse source has for example two channels and simultaneously generates two radiation patterns, a sum pattern and a difference pattern. This source must have radioelectrical sources that are compatible with the matching and radiation performance characteristics of a full focal feed antenna. These characteristics relate in particular to the matching frequency band, the formation of the pattern of the difference channel in the plane of the electrical field E and the apertures and the relative level of the radiation patterns of the sum and difference channels.

In certain applications such as automobile vehicles for example, the source must furthermore comply with, technological and economic criteria, both general and specific. These criteria are as follows:

- ease of connection and installation as close as possible to the microwave transmission and reception circuit which is made by microstrip technology, so as to minimize the lengths of the lines where the major losses in the millimeter wave band, for example in the range of 80 dB, can soon place limits on the performance characteristics of the system;
- the shielding of the microwave transmission and reception circuit against external electromagnetic effects outside the operating band of the system;
- the compactness in depth of the primary source which should have, for example, a depth of less than 5 mm;
- the imperviousness and possibly hermetically sealed character of the transmission and reception circuits with respect to external environmental effects with the assembly constituted by the transmission and reception circuit and the primary source;
- manufacture by conventional manufacturing means and tolerance in operation with respect to dimensional variations obtained with these manufacturing means within the context of very low-cost mass production.

One way of making a primary source that meets certain of the above criteria consists of the use of a pyramidal horn excited by a magic-T circuit folded in the plane of the electrical field E. Depending on the access used, this magic-T circuit is used for the generation, in the horn, of the transverse-electric mode TE01, namely the even mode, or the transverse-magnetic mode TM11, namely the odd mode. These modes respectively form the sum and difference patterns. However, this approach entails a large space requirement in depth and, in order to be made, calls for the manufacture and assembly of several high-precision parts leading to the use of expensive machining methods such as wire electroerosion or electroforming.

In another approach, a printed circuit source is made on the same substrate as the microwave emission circuit. To form radiation patterns with the desired directivity, this source should be formed by an array of patch type radiating elements fed for example by a hybrid ring. This approach has the advantage of not requiring any mechanical parts and of taking up minimum space in depth, but does not meet the requirements of electromagnetic shielding and protection against environmental effects for the components of the microwave transmission and reception circuit. Furthermore, patch type radiating elements have frequency selective operation and are therefore highly sensitive to the characteristics of the substrate, especially for example its dielectric constant or its thickness, and also to the etching tolerance characteristics.

SUMMARY OF THE INVENTION

The aim of the invention is to overcome the above-mentioned drawbacks and to make it possible especially to obtain a source that meets the criteria referred to here above. To this end, an object of the invention is a monopulse source for a focal feed antenna, comprising at least two waveguides machined in the metal flange supporting the microwave transmission and reception circuit of the antenna.

The main advantages of the invention are that it can be applied both to a backfire type antenna and to a forward type antenna, provides access to the source by a microstrip line, makes it possible to modify the directivity of the radiation patterns in the magnetic plane H and in the electrical plane E, enables low-level radioelectrical leakages, enables the active components of the transmission and reception circuit to be arranged in the vicinity of the source, and is simple to implement and is economical.

BRIEF DESCRIPTION OF THE DRAWINGS

Other features and advantages of the invention shall appear from the following description made with reference to the appended drawings of which.

DETAILED DESCRIPTION OF THE PREFERRED EMBODIMENTS

Figure 1A:
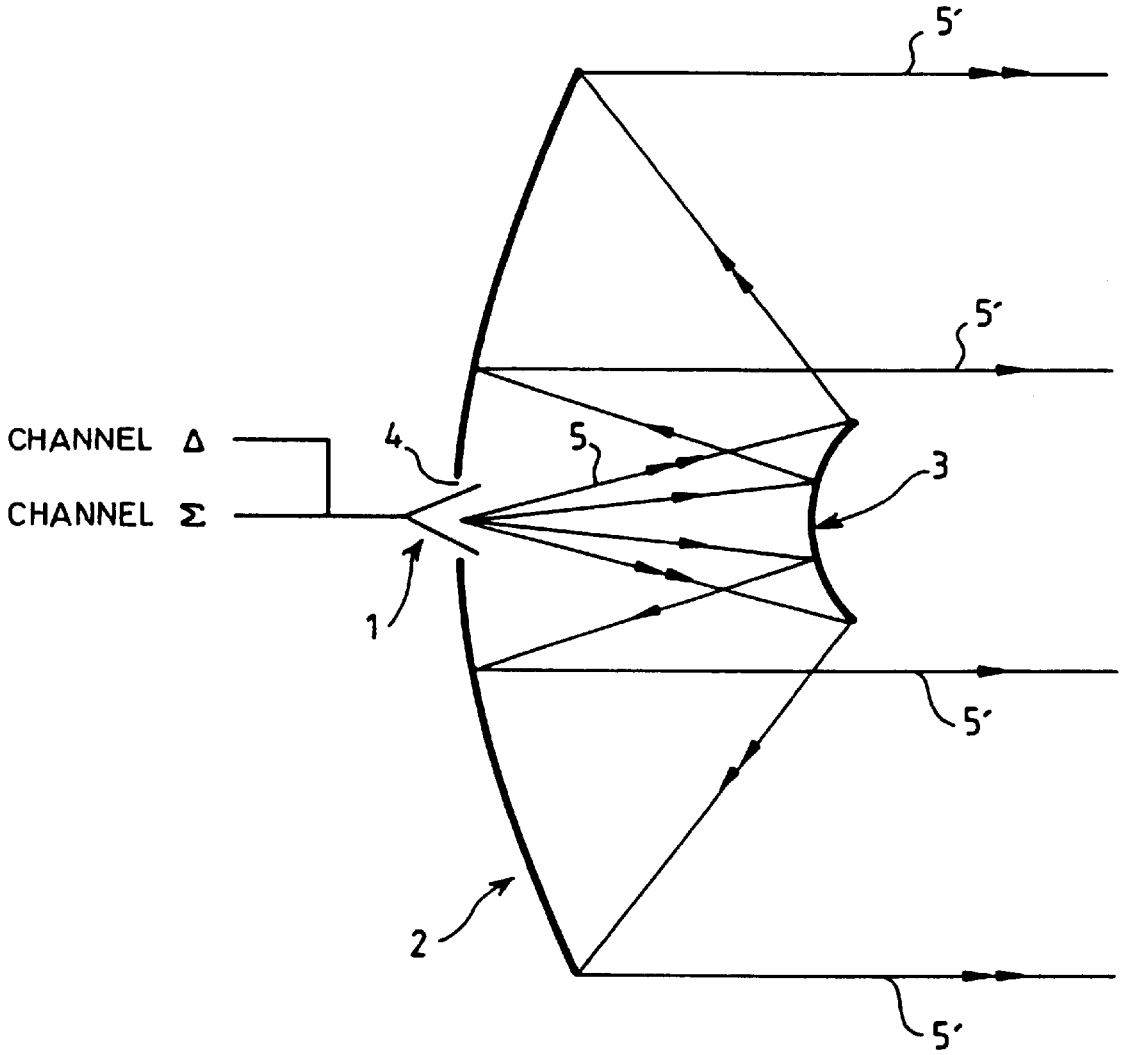
FIG. 1*a* shows an exemplary backfire type antenna fed by a primary monopulse source.

FIG. 1*a* shows an exemplary backfire type antenna fed by a primary source 1 known as a monopulse source, that is to say a source with two channels, a sum channel Σ and a difference channel Δ. The antenna comprises a main reflector 2, for example of the parabolic type, and a sub-reflector 3. The primary source 1 is positioned behind the main reflector 2 and radiates through a hole 4 made in this reflector. The sub-reflector 3 is positioned so as to be facing the primary source 1. The rays 5 emitted from the primary source 1 get reflected on the sub-reflector 3 and then on the main reflector 2. After reflection on this main reflector 2, the waves 5' are transmitted in parallel to the antenna output.

Figure 1B:
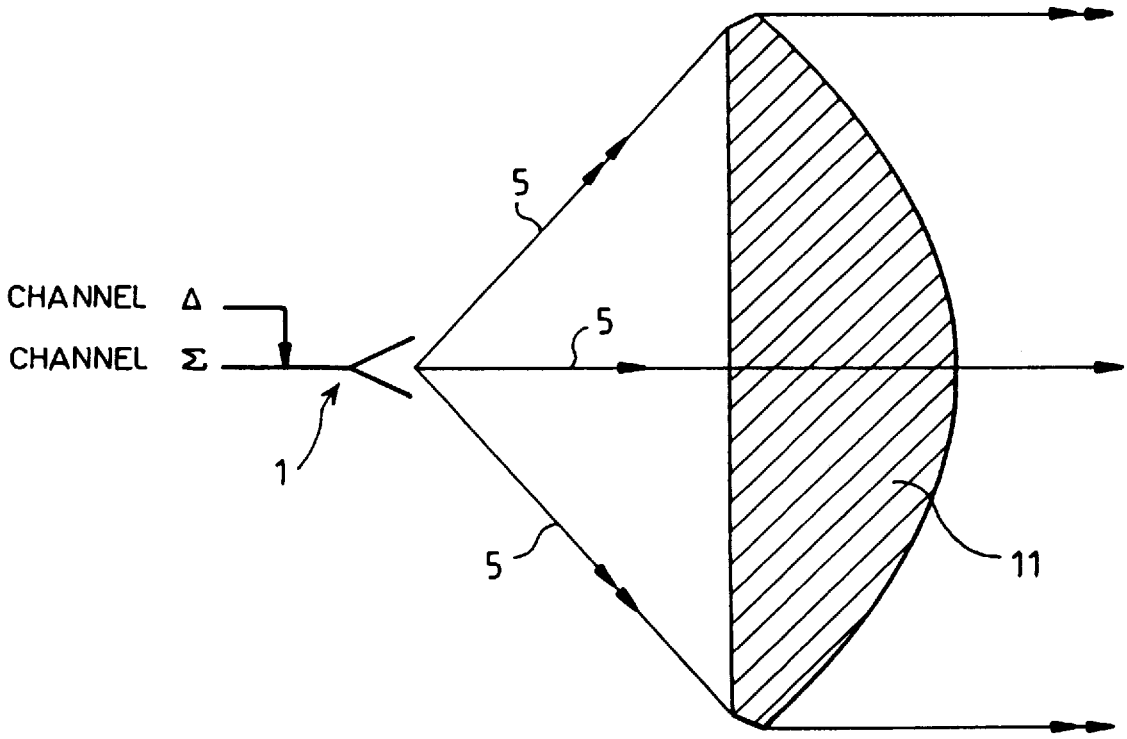
FIG. 1*b* shows an exemplary forward antenna fed by a primary monopulse source.

The invention can be applied to a backfire antenna but it can also be applied for example to a forward antenna as illustrated in FIG. 1*b*. This antenna comprises for example a dielectric lens 11 that focuses the rays 5 emitted by the source 1 to infinity. The source 1 also has two channels, a sum channel Σ and a difference channel Δ.

Figure 2:
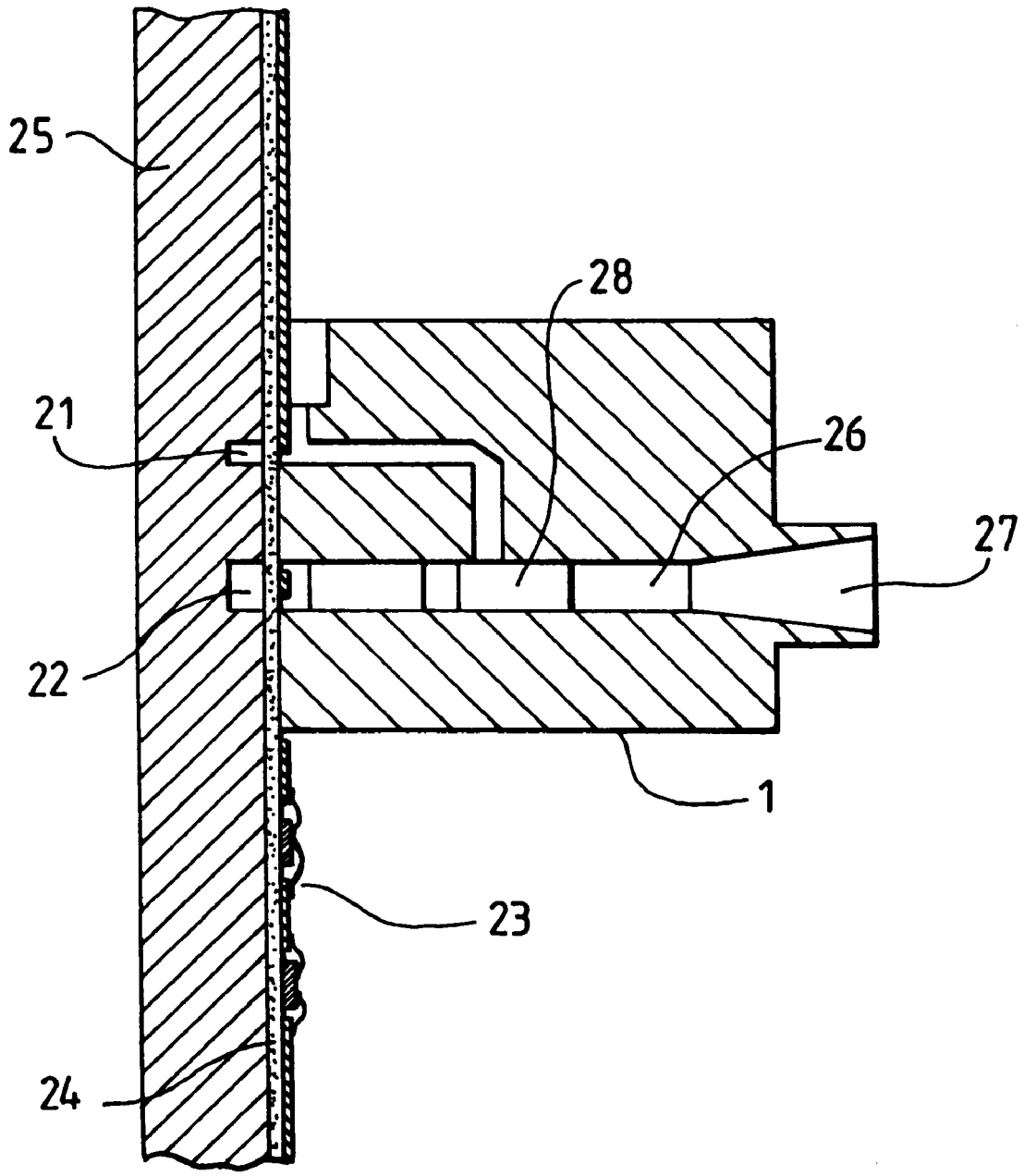
FIG. 2 shows an exemplary primary source according to the prior art.

FIG. 2 shows an exemplary embodiment of the prior art. The primary source 1 uses a rectangular waveguide 26 extended by a pyramidal horn 27. The sum and difference channels of the magic-T circuit 28 are fed by means of waveguide-microstrip transitions 21, 22. The transmission and reception circuits 23, made by microstrip technology, are implanted for their part on a dielectric substrate 24 which is for example positioned on a metal flange 25. The waveguide is excited by the magic-T circuit 28 folded in the plane of the electrical field E. Depending on the access used, this magic-T circuit is used to generate the transverse-electric mode TE10, namely the even mode, or the transverse-magnetic mode TM11, namely the odd mode, in the horn. The two modes respectively form the sum and difference radiation patterns. The access to the difference channel of the magic-T circuit can be obtained through an elbow made in the plane of the electrical field E, in the same plane as the access to the sum channel. This source may then be connected to the transmission and reception circuit 23 by two microstrip-guide transitions 21, 22. This approach unfortunately requires a great amount of space in depth, for example about 35 mm in millimeter wave band and, as indicated here above, requires the manufacture and assembly of several high-precision parts such as for example a magic-T circuit and the microstrip-guide transitions 21, 22. This leads to the use of cumbersome machining methods. These methods are for example wire electroerosion or electroforming.

Figure 3:
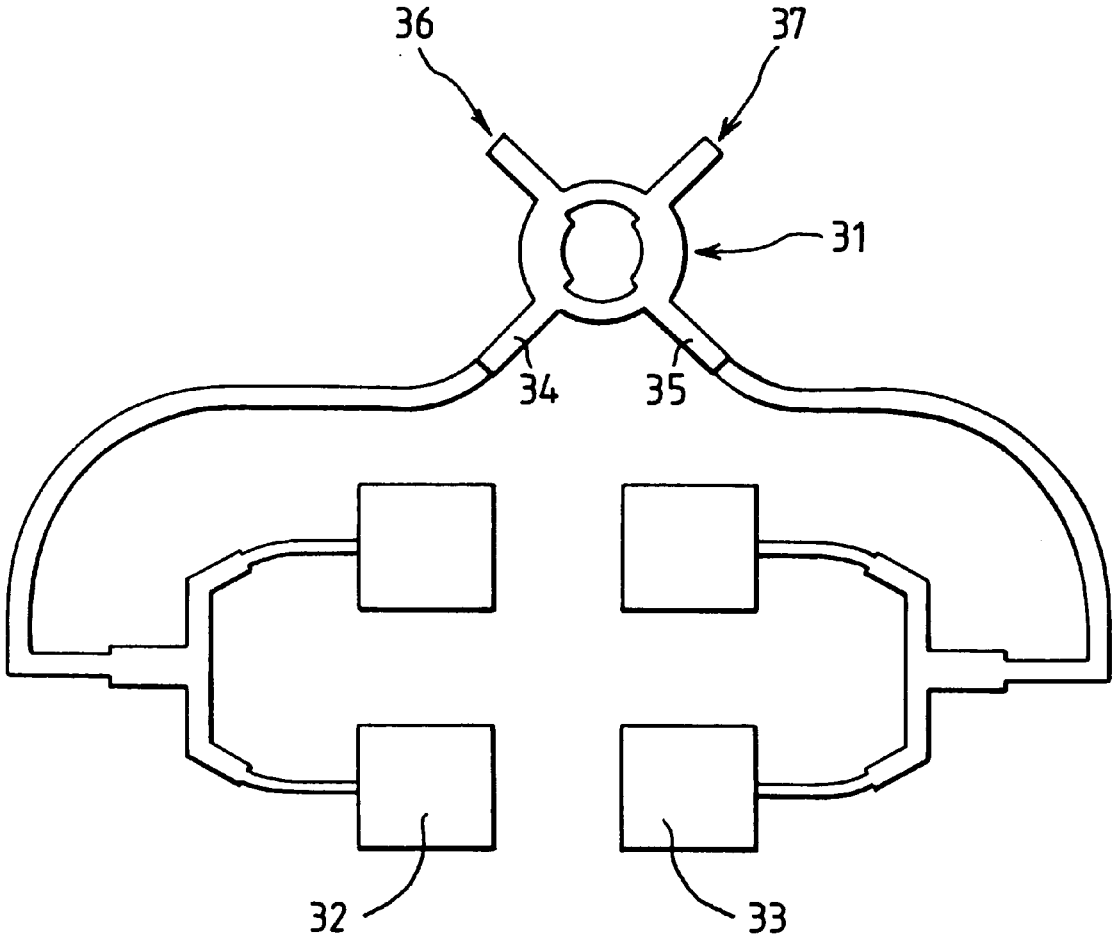
FIG. 3 shows another exemplary primary source according to the prior art.

FIG. 3 shows another known embodiment. The source is printed on the same substrate as the transmission and reception circuit. It comprises a 4λ/4 type balanced hybrid ring 31 or an array of two pairs of radiating elements or patches 32, 33. To form the radiation patterns having the desired directivity, the ring 31 feeds the radiating elements by means of two outputs 34, 35, one of which is extended by a quarter wavelength λ/4 over the other so as to feed the two radiating elements 32, 33 in phase or in phase opposition depending on the input 36, 37 of the ring that is excited. The radiation pattern of the sum channel is thus formed when the two pairs are excited in phase and the radiation pattern of the difference channel is thus formed when the two pairs are excited in phase opposition. As indicated above, this exemplary embodiment has the advantage of requiring no mechanical parts and of having a minimum space requirement in depth. However, it does not meet the requirements of electromagnetic shielding and protection against environmental stresses for the components of the microwave transmission and reception circuit. Furthermore, the radiating patches 32, 33 have a frequency-selective operation and are therefore highly sensitive to the characteristics of the substrate such as its dielectrical constant or its thickness as well as the etching tolerances.

Figure 4:
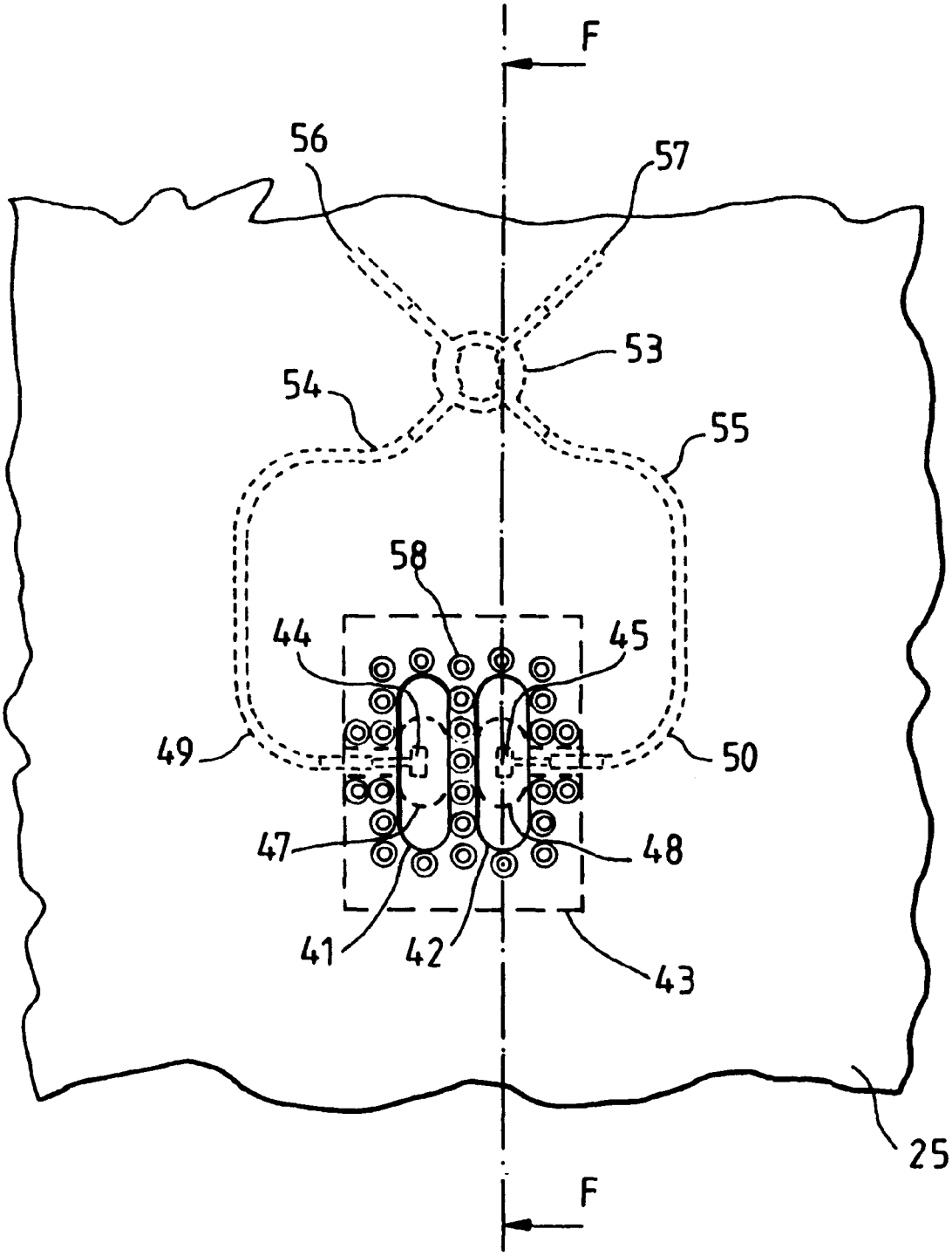
FIG. 4 shows an embodiment of an exemplary source according to the invention in a front view F' of FIG. 5, facing the metal flange.
Figure 5:
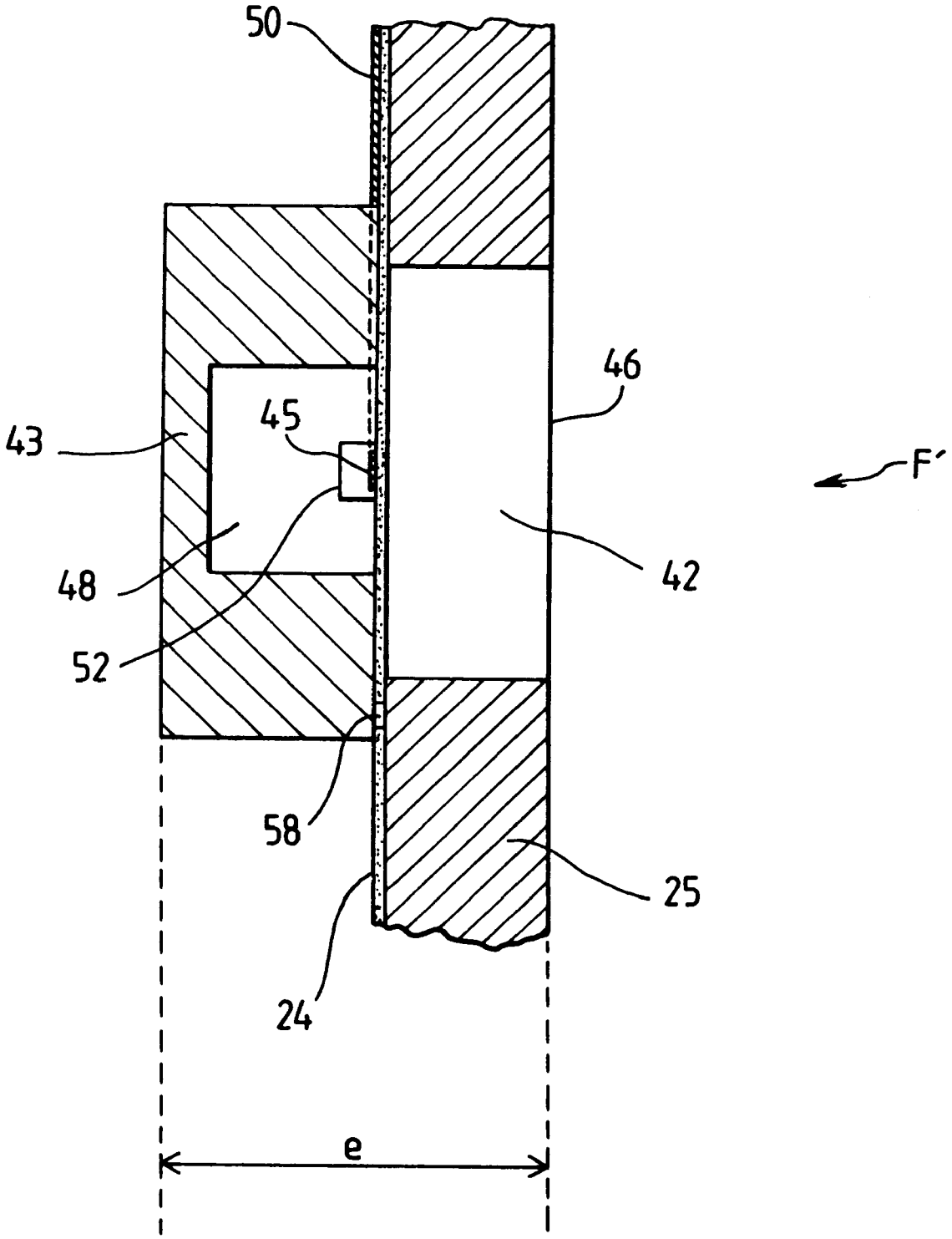
FIG. 5 shows a sectional view along line F—F of FIG. 4.
Figure 6:
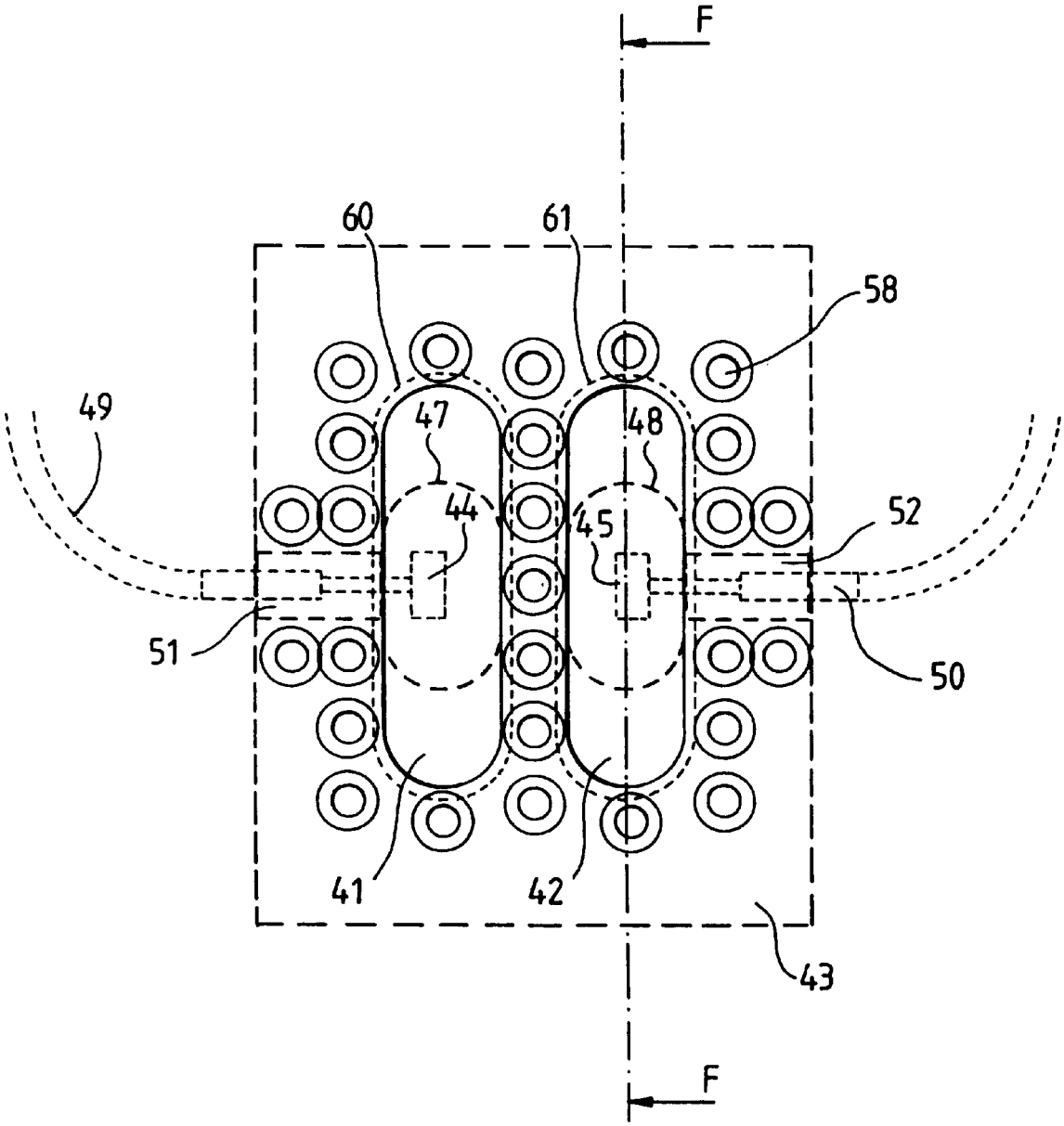
FIG. 6 shows a detail of FIG. 4 at the level of the radiating elements.

FIGS. 4, 5 and 6 for example show an exemplary embodiment of a primary source according to the invention. This source has two radiating waveguides 41, 42 (FIGS. 4 and 6) machined in the metal flange 25 (FIGS. 4 and 5) supporting the microwave transmission and reception circuit of the antenna. This circuit is for example a microstrip circuit and/or an MMIC monolithic microwave integrated circuit. The transmission and reception circuit is positioned for example on a dielectric substrate 24 (FIG. 5) which is mounted on the metal flange 25. The microstrip lines are for example silk-screen-printed or etched on the substrate. The large side of the waveguides 41, 42 is for example sized to enable the propagation of the transverse-electric mode TE01 and to obtain the desired directivity of the sum channel radiated pattern in the magnetic plane H. The distance between the two waveguides 41, 42 is determined for example to obtain the desired directivity of the sum channel radiated pattern in the plane of the electrical field E. Advantageously, it is possible to modify the directivity of the radiation patterns in the plane of the magnetic field H by changing the dimension of the large side of the waveguides 41, 42 and it is possible to modify this directivity in the plane of the electrical field E by changing the difference between these two waveguides.

The metal of the ground plane of the microstrip circuit is eliminated at the two waveguides 41, 42 so as to let through radiation. The etching 60, 61 (FIG. 6) of the ground plane on the dielectric substrate then circumvents the end of the waveguides. Each waveguide is for example excited by a transition 44, 45 (FIGS. 4 and 6) with the transmission and reception circuit, which is for example a microstrip circuit, this transition being constituted for example by an etched pattern 44, 45 on the same substrate as the one supporting the microstrip circuit and by a microwave short-circuit 43 closing the waveguide. The high degree of mismatching of the radiating mouth 46 (FIG. 5) of each waveguide 41, 42 is advantageously compensated for by a change in section placed at a given distance from each of these mouths, each waveguide being extended by a smaller waveguide 47, 48 (FIGS. 4 and 6) from this change in section. The reduction of the section is obtained for example on the large side of the waveguide, and is a reduction by a factor of two for example. Each transition 44, 45 with the microstrip circuit is positioned in the section changing plane. A transition 44, 45 is matched by the microwave short circuit 43 closing the reduced waveguide 47, 48 and placed at a distance substantially equal to the quarter wavelength λ/4 of the signal transmitted by the microstrip circuit. Each transition 44, 45 is fed for example by a microstrip line 49, 50 (FIGS. 4 and 6) passing beneath a tunnel 51, 52 (FIG. 6) made in the wall of the reduced waveguide. Each transition 44, 45 is then connected for example to a 4λ/4 type balanced hybrid ring 53 (FIG. 4), one of whose outputs 55 (FIG. 4) is extended by a quarter wavelength λ/4 with respect to the other output 54 (FIG. 4). These links 49, 54, 50, 55 (FIG. 4) are used for the feeding in phase or phase opposition of the two radiating elements along the input 56, 57 (FIG. 4) of the ring 53 which is excited and thus make it possible to form the patterns of the sum and difference channels, the difference channel being for example obtained in the plane of the electrical field E. The two inputs 56, 57 of the hybrid ring are connected to the rest of the transmission and reception circuit 23 (not shown). Each of the above-mentioned radiating elements is in fact constituted by a mouth 46 of a waveguide and a transition 44, 45 with the microstrip circuit. The active components of the transmission and reception circuit may be placed in the vicinity of the source. This makes it possible especially to limit the microwave losses. Advantageously, the protection of the microwave transmission and reception circuit against the external parasitic electromagnetic radiation located outside the operating band of the radar is provided by the presence of the waveguides which play the role of highpass filters.

The section of the waveguides 41, 42, 47, 48 (FIG. 6) is for example oblong instead of being rectangular. This makes it possible in particular to avoid the use of cumbersome machining methods such as wire electroerosion. The oblong sections for their part may be made simply by economical machining means such as milling. Furthermore, the architecture of a source according to the invention enables it to have a wide passband especially through the use of a non-selective excitation element which makes the manufacturing tolerance values of the mechanical parts and of the microstrip circuit less critical and therefore makes a further contribution to reducing the manufacturing costs.

The short-circuit 43 for matching the transitions 44, 45 and the reduced section waveguides 47, 48 may be machined in one and the same part. This makes it possible especially to reduce the number of parts to be machined. This part may be assembled with and positioned in relation to the metal flange 25 and especially the microstrip circuit and the waveguides 41, 42 by any method such as, for example, screwing, brazing or bonding. In order to limit microwave leakages, this part 43, 47, 48 may be connected electrically by at least one point but preferably by several points to the metal flange 25 supporting the microstrip technology circuit. To this end, metallized holes 58 (FIGS. 4,6,7*a* and 7*b*) may be made in the dielectric substrate opening out, for example, on to the periphery of the waveguides 41, 42 machined in the metal flange 25.

The metal flange 25 in which the radiating waveguides 41, 42 are made may form for example an integral part of the transmission and reception circuit. This makes the embodiment even more compact and also reduces the number of parts to be machined.

Further, the waveguides may be filled with a dielectric material 60 (see FIG. 5). Also shown in an axis "A" of the microwave short-circuit which coincides with an axis of the waveguide 42.

Figure 7A:
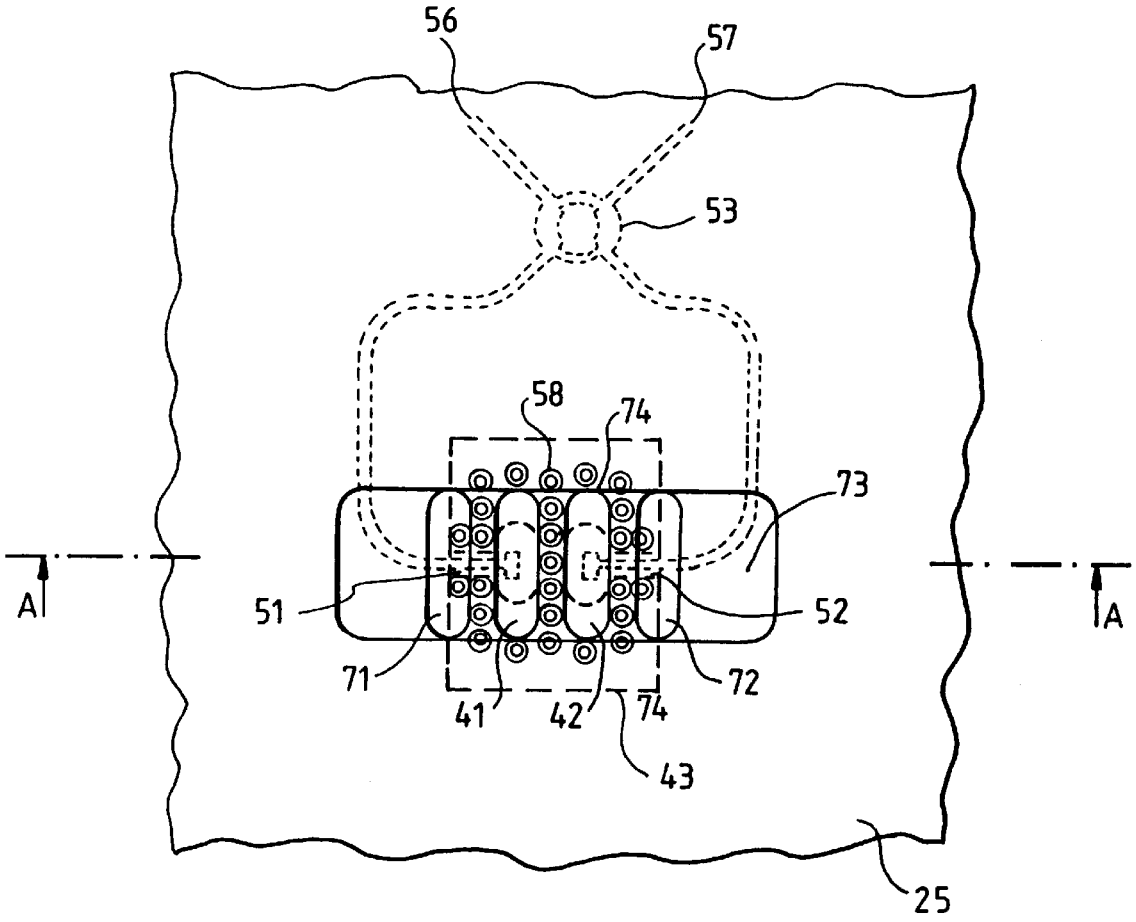
FIGS. 7*a* and 7*b* show an possible embodiment of a source according to the invention where the machining of the metal flange modifies the radiation pattern, FIG. 7*b* being a sectional view of FIG. 7*a* along section line AA.
Figure 7B:
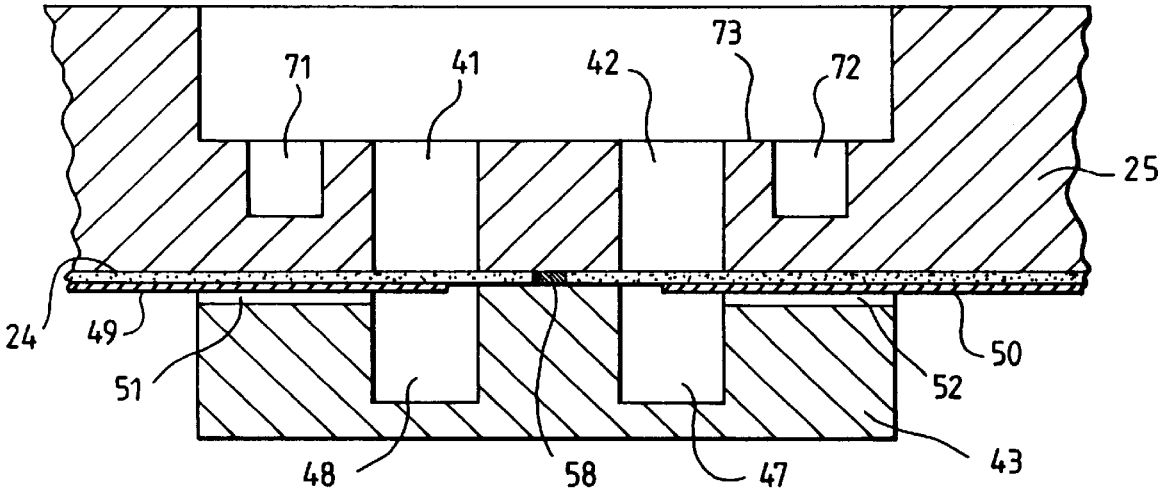

FIGS. 7*a* and 7*b* show an embodiment of a primary source according to the invention used to obtain a particular radiation pattern of the sum and/or difference channels of the source, for example to obtain a better matching with the characteristics of the focal feed array. To this end, false slots 71, 72 are added to the vicinity of the waveguides 41, 42 machined in the metal flange 25. These false slots 71, 72 are holes that do not entirely cross the flange 25. These false slots which for example have the same cross-section as the waveguides are actually traps that are excited by coupling through the proximity of the waveguides. The energy picked up by the coupling with these waveguides 41, 42 is radiated. As a result, there is the equivalent of four radiating sources whose phase can be controlled for example by changing the position of the traps and their depth. This makes it possible to obtain a radiation pattern that is more directional, thus preventing energy losses, especially in the case of application to a focal feed optical system. Indeed, a more directional pattern prevents a part of the radiation from being intercepted by the lens. This therefore reduces the above-mentioned losses which are generally called "spill-over" losses. The false slots 71, 72 especially have the effect of eliminating the coincidence of the phase centers of the planes of the electrical and magnetic fields. According to the invention, to make these phase centers coincide again, the thickness of the flange is reduced at the level of the waveguides and the false slots. For this purpose, a surface 73 (FIG. 7*b*) is made for example by countersinking within the flange 25. This surface 73 as well as the false slots 71, 72 are obtained for example during the same machining operation as the waveguides 41, 42 of the metal flange 25. Preferably, to obtain better coincidence between the phase centers, the reduction of the thickness of the flange 25 begins substantially at the position 74 (see FIG. 7*a*) which is on the waveguides 41, 42 and the false slots 71, 72.

FIGS. 4, 5, 6 and 7 describe an exemplary embodiment of a primary monopulse source with two channels. The invention can nevertheless be applied to three-channel sources, for example with a sum channel and a difference channel in the plane of the electrical field E and a difference channel in the plane of the magnetic field H. This source is then for example obtained by associating four radiating elements fed by four hybrid rings, each radiating element being constituted for example by a mouth 46 of a waveguide and a transition with the microstrip circuit as described here above.

The invention may furthermore be applied to make a primary source illuminating a multiple beam antenna. This source is formed for example by several radiating elements such as the ones mentioned here above placed in the focal plane of a Cassegrain type reflector system or in the focal plane of a dielectric lens, each radiating element generating a beam whose tilt depends on the position of the elementary source with respect to the focus.

Advantageously, the invention provides very efficient protection for the circuits against environmental effects such as for example humidity or corrosion by partially or totally filling the radiating waveguides with a dielectrical material. Protection of this kind is advantageous especially for automobile-installed radars that are liable to undergo the above-mentioned stresses.

Finally, a source made according to the invention occupies a small amount of space "e" in depth (see FIG. 5). The depth may be for example about 5 mm in the millimetrical band. The space occupied may extend from the outer end of the microwave short circuit 43 to the output 46 of a waveguide 41, 42.

What is claimed is:

1. A monopulse source for a focal feed antenna, comprising:

at least two waveguides machined in a metal flange supporting a microwave transmission and reception circuit of the antenna;

a dielectric substrate on the metal flange;

a respective microwave short-circuit having an opening with a smaller cross-sectional dimension than a cross-sectional dimension of a corresponding one of said at least two waveguides, said respective microwave short-circuit being mounted on the dielectric substrate such that an axis of the respective microwave short-circuit coincides with an axis of the corresponding one of said at least two waveguides; and a respective transition positioned on the dielectric substrate and within the corresponding opening of the respective microwave short-circuit, and configured to excite the respective waveguide.

2. A source according to claim 1, wherein the transmission and reception circuit is disposed on the dielectric substrate mounted on the metal flange.

3. A source according to claim 2, wherein the transmission and reception circuit comprise silk-screen-printed microstrip lines on the dielectric substrate.

4. A source according to claim 2, further comprising:

metallized holes in the dielectric substrate to connect the respective microwave short-circuit electrically to the metal flange.

5. A source according to claim 1, wherein the transition is fed by a respective microstrip line passing beneath a corresponding tunnel located in a wall of the respective microwave circuit.

6. A source according to claim 5, wherein the respective microstrip line is connected to a hybrid ring used to feed the respective transition either in phase or in phase opposition to form sum and difference patterns depending on a corresponding input of the hybrid ring that is excited.

7. A source according to claim 1, wherein the at least two waveguides respectively comprise an oblong-shape.

8. A source according to claim 1, wherein the respective microwave short-circuit having the opening is a single part.

9. A source according to claim 8, further comprising:

metallized holes in the dielectric substrate to connect the respective microwave short-circuit electrically to the metal flange.

10. A source according to claim 1, wherein the metal flange is an integral part of the transmission and reception circuit.

11. A source according to claim 1, wherein the corresponding one of at least two waveguides is filled with a dielectric material.

12. A source according to claim 1, wherein false slots radiating by coupling with the at least two waveguides are added to a vicinity of the at least two waveguides.

13. A source according to claim 12, wherein the false slots and the at least two waveguides have substantially the same cross-section.

14. A source according to claim 12, wherein a thickness of the metal flange is reduced in an area of the at least two waveguides and the false slots.

15. A source according to claim 14, wherein a reduction of the thickness of the metal flange begins substantially at a position of the at least two waveguides and the false slots.

16. A source according to claim 1, wherein the transition comprises a pattern etched on the substrate bearing the transmission and reception circuit.

* * * * *